United States Patent [19]

Stone

[11] 4,054,171

[45] Oct. 18, 1977

[54] METHOD AND APPARATUS FOR STARTING THE CONTINUOUS CASTING OF A METAL

[75] Inventor: Kenneth Ray Stone, Carrollton, Ga.

[73] Assignee: Southwire Company, Carrollton, Ga.

[21] Appl. No.: 759,088

[22] Filed: Jan. 13, 1977

[51] Int. Cl.[2] ..... B22D 11/06

[52] U.S. Cl. ..... 164/87; 164/121; 164/128; 164/438; 164/434

[58] Field of Search ..... 164/86, 87, 95, 121, 164/274, 278, 128

[56] References Cited

U.S. PATENT DOCUMENTS

| | | | |
|---|---|---|---|
| 3,274,681 | 9/1966 | Lohman | 164/95 X |
| 3,421,571 | 1/1969 | Webber et al. | 164/86 |
| 3,596,702 | 8/1971 | Ward et al. | 164/87 |
| 3,789,911 | 2/1974 | Bochner | 164/95 X |
| 3,847,203 | 11/1974 | Northwood | 164/95 X |
| 3,937,270 | 2/1976 | Hazelett et al. | 164/121 X |

*Primary Examiner*—Ronald J. Shore
*Attorney, Agent, or Firm*—Van C. Wilks; Herbert M. Hanegan; Stanley L. Tate

[57] ABSTRACT

A method and apparatus for of starting the continuous casting of a first metal in the mold of a continuous casting machine, in which a molten second metal having a melting point lower than that of the first metal is first introduced into the mold of the casting machine at a temperature substantially below the melting point of the first metal and in which the introduction of the second metal is discontinued and the casting of the first metal is begun after cooling of the mold has caused the second metal to form a solidified plug within the mold and while the cooling of the mold continues. The apparatus includes means for the sequential casting of the second and first metals in a casting machine while the casting machine is being cooled and the method allows metals of very high melting point, such as steel, to be continuously cast without damaging the mold or creating undue danger to the operator.

27 Claims, 3 Drawing Figures

METHOD AND APPARATUS FOR STARTING THE CONTINUOUS CASTING OF A METAL

BACKGROUND OF THE INVENTION

The present invention relates to the continuous casting of metals in molds and more particularly to the casting of metals in molds formed by closing the peripheral groove of a rotatable casting wheel with a continuous flexible band, and to a method and apparatus for starting the casting of such metals.

In the casting of molten metal in the mold of a casting wheel, particular problems which arise when the molten metal is first introduced into the mold must be overcome. One problem is that the shock of the heat transfer from the molten metal to the material of the relatively cool casting wheel and flexible band is significant and can cause substantial deterioration of these materials.

In order to minimize this deterioration, continuous casting wheels are generally cooled using a liquid coolant which is applied to some or all of the exterior surfaces of the mold. However, if the molten metal surrounds any liquid coolant adhering to the interior surface of the mold to form a pocket of coolant, the heat of the molten metal will quickly vaporize the coolant and cause the resulting gas to expand so rapidly that the pocket which has been formed will literally explode and propel molten metal from the mold.

Therefore, in spite of the requirement for maximum cooling of the mold to prevent deterioration of mold materials, it is necessary to postpone full volume cooling of the exterior of the mold until just after the molten metal has begun to be poured into the mold so as to avoid pockets of coolant. A method of low volume preliminary cooling is described in U.S. Pat. No. 3,596,702, issued to George C. Ward on Aug. 3, 1971, and has been effective to minimize thermal shock and deterioration problems in the continuous casting of metals having relatively low melting points, such as copper, aluminum and lead, while at the same time minimizing the possibility of explosive reactions between the molten metal and coolants splashed into the mold. The disclosure of said patent is expressly incorporated herein by reference.

In the casting of metals of relatively high melting points, such as steel, the problems of starting continuous casting in a casting wheel are greatly magnified. The temperature of molten steel, for example, is not only high enough to cause heat deterioration to the mold, but is normally above the melting point of the constituents of the mold since the casting wheel is normally constructed of materials which have high heat conductivity to allow efficient cooling but which tend to have relatively low melting points.

Furthermore, the high temperatures of these metals in their molten state makes their contact with liquid coolant adhering to the interior surfaces of the mold an even more explosive and significantly more dangerous event compared to metals having a significantly lower melting point. Thus, the methods of preliminary cooling in connection with direct introduction of the metal to be cast which have been successful in starting the continuous casting of metals having relatively low melting points will not sufficiently protect the mold from the possibility of melting or heat deterioration, while at the same time providing a sufficient margin of safety for the operator or the equipment against the possibility of explosion if metals of significantly higher melting points are cast.

SUMMARY OF THE INVENTION

Briefly described, the present invention comprises a method and apparatus for starting the continuous casting of a first metal having a particular melting point in a mold formed by closing the peripheral groove of a rotatable casting wheel with a continuous flexible band wherein a molten second metal having a melting point lower than the melting point of the first metal is first introduced into the mold at a temperature substantially below the melting point temperature of the first metal without the application of coolant or with the application of coolant at low volume as in the prior art, coolant is then applied to the mold at full volume, and when a cross section of the mold is filled by solidified second metal, the introduction of second metal is terminated, and molten first metal is introduced into the mold while the full volume cooling of the mold is continued.

Thus, it is an object of this invention to provide a method and apparatus for starting the continuous casting of a metal using a rotatable casting wheel without any hazards of explosion due to the inadvertent mixing of coolant with molten metal having a melting point which is high relative to those of such metals as copper, aluminum, lead, and zinc.

Another object of this invention is to provide a method and apparatus for starting the continuous casting of a metal using a rotatable casting wheel, which method and apparatus protects the casting wheel and flexible band from metal fatigue, deterioration, or melting point during the initial operation of the casting wheel as a result of the high temperature of the metal when cast relative to that of metals such as copper, aluminum, lead, and zinc.

Another object of this invention is to provide a method and apparatus for starting the continuous casting of a metal having a relatively high melting point wherein the mold of the casting wheel is preheated by the casting of a metal having a lower melting point.

Another object of this invention is to provide a method and apparatus for starting the continuous casting of a metal having a relatively high melting point using a rotatable casting wheel wherein the cooling system of said casting wheel is operating at full volume when the metal is introduced into the mold of the casting wheel.

Other objects, features and advantages of the present invention will become apparent upon reading the following specification, when taken in conjunction with the accompanying drawing.

DESCRIPTION OF THE PREFERRED EMBODIMENTS

Figure 1:
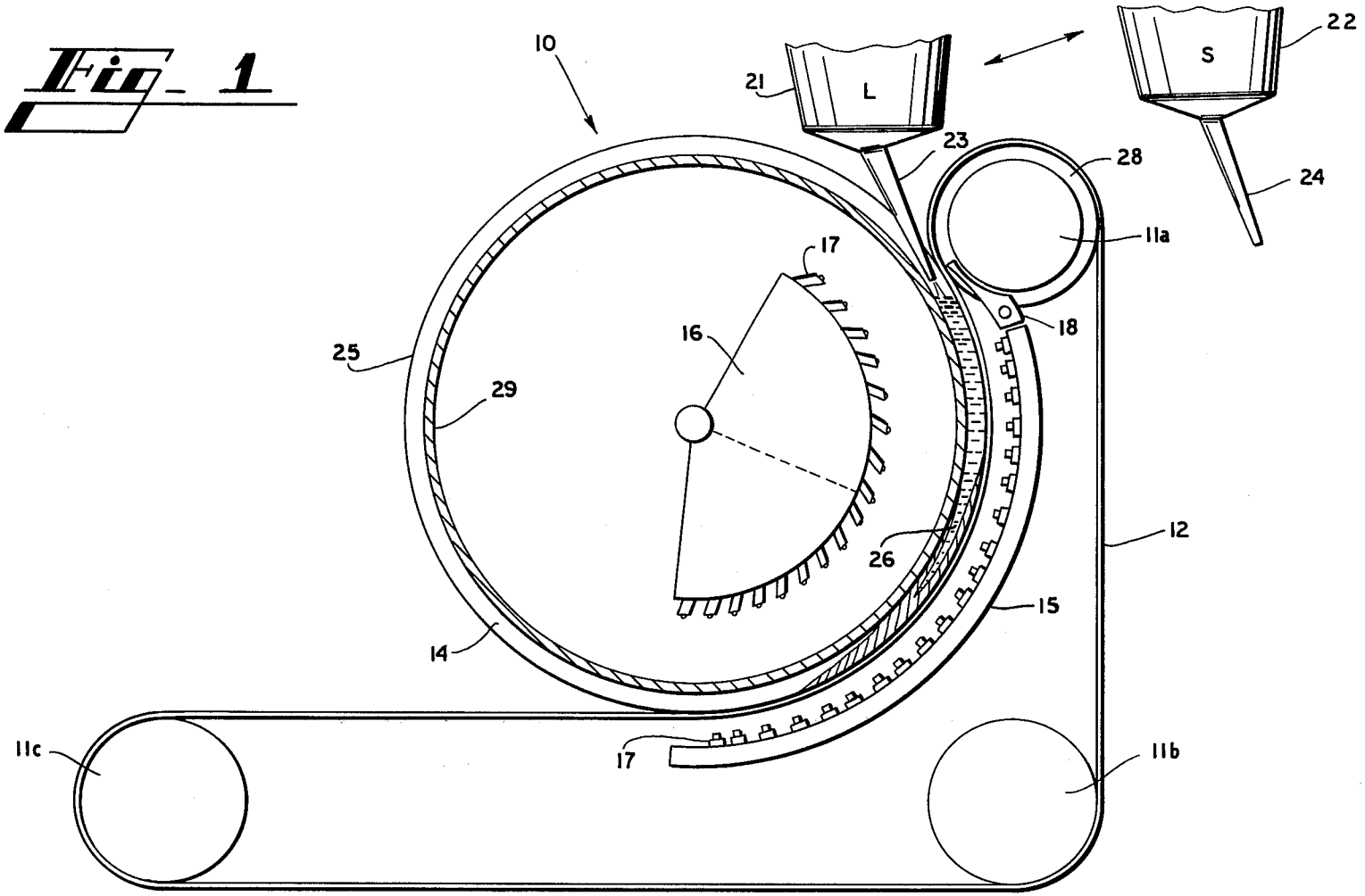
FIG. 1 is a side cross-sectional view of a continuous casting machine embodying the apparatus of the invention and arranged to practice the method of the invention, with the interchangeable tundishes shown diagrammatically.

Referring now in more detail to the drawing, in which like numerals indicate like parts throughout the several views, FIG. 1 shows a casting machine 10 which includes a casting wheel 25 which has a peripheral groove 14 therein. A flexible band 12 is guided by band positioning rollers 11*a*, 11*b*, 11*c*, and engages the periphery of the casting wheel to close the peripheral groove 14 and form an arcuate mold cavity which extends about a portion of the circumference of the casting wheel 25. The band positioning rollers 11*a*, 11*b*, 11*c*, function to hold the continuous band 12 in position to move at the same speed as the rotation of the casting wheel 25.

Pouring pots or tundishes 21 and 22 contain different molten metals and alternately deliver the molten metal through their respective pouring spouts 23 and 24 into the mold formed by the peripheral groove 14 and the flexible band 12 at the point where the flexible band 12 meets the periphery of the casting wheel 25. The tundishes may be equipped with metering devices of the type disclosed in U.S. Pat. No. 3,331,539 for controlling the flow of molten metal from the tundish.

In one embodiment of the invention, the two tundishes 21 and 22 are movable into and out of pouring position by means of appropriate supports and controls (not shown), such as by suspension on chains from movable booms, which will be understood by those skilled in the art.

Figure 2:
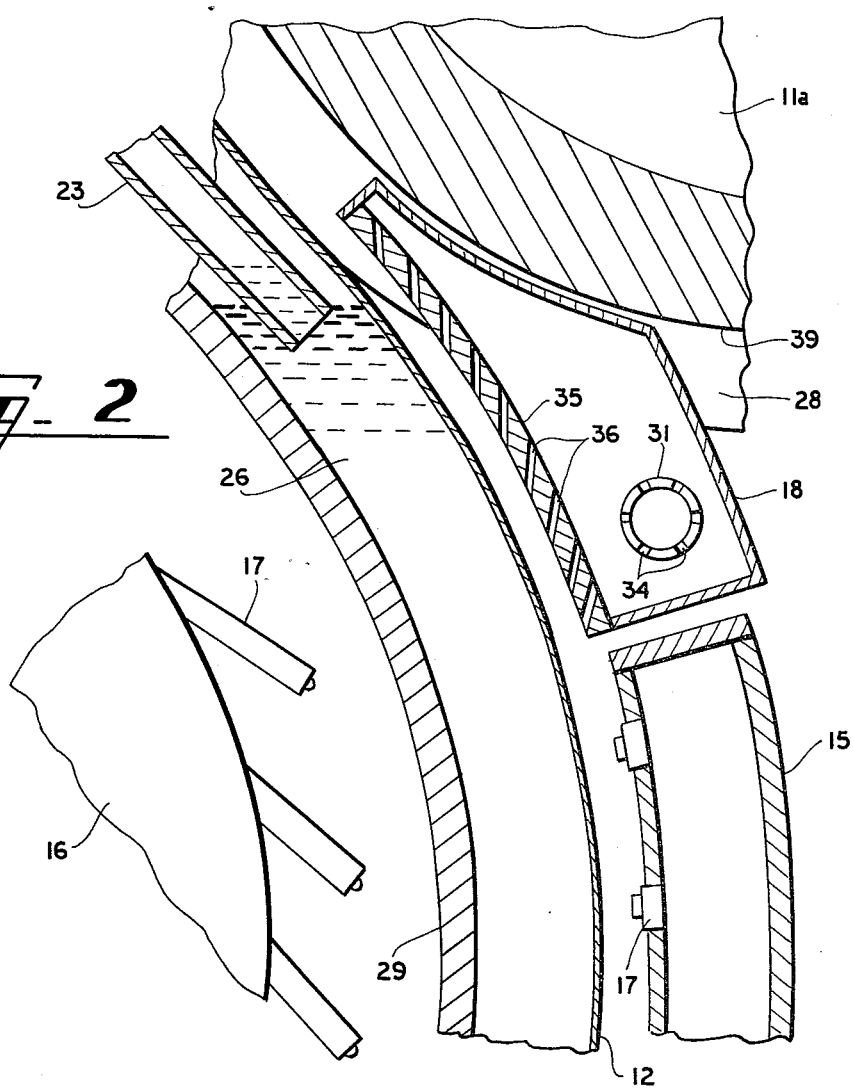
FIG. 2 is a detailed showing of the portion of the casting machine of FIG. 1 at which the flexible band initially makes contact with the peripheral groove of the casting wheel, and shows the mold, the tip of the pouring spout, and the nip nozzle assembly.

As is best shown in FIG. 2, band positioning roller 11*a* defines an annular groove 28, and nip nozzle assembly 18 is positioned closely adjacent band positioning roller 11*a* and it projects into groove 28. Nipnozzle assembly 18 is of the type disclosed in U.S. Pat. No. 3,333,629 and includes a supply duct 31 and a wedge-shaped nozzle 32 which projects into annular groove 28. Supply duct 31 defines openings 34 within nozzle 32. Nozzle 32 includes a nozzle face plate 35 which is formed with a curvature matching the curvature of the periphery of the casting wheel 25, and a plurality of nozzle openings 36 extend through nozzle face plate 35. Nozzle openings 36 are formed so that they are directed generally in a downward direction from band positioning roller 11*a*, and the coolant passing through nozzle opening 36 will flow primarily only in a downward direction. Nip nozzle assembly 30 is of the type used in the process of preliminary cooling in the casting of metals having relatively low melting points as described in U.S. Pat. No. 3,596,702.

For full volume cooling, a pair of headers 16 are positioned within the casting wheel adjacent the interior surface 29 of the mold. A plurality of nozzles 17 extend from the outer curved portion of casting wheel headers 16 and function to spray coolant upon the inner surface 25 of the mold.

Band header 15 is also provided immediately adjacent and below nip nozzle assembly 18 and extends in a downward direction around casting wheel 25 to the point where the flexible band 12 is guided away from casting wheel 25. Additional nozzles 17 function to spray coolant onto the exterior of flexible band 12 where it is engaged with the periphery of casting wheel 25. Coolant, usually water, is supplied to headers 15 and 16 through conduits (not shown).

Figure 3:
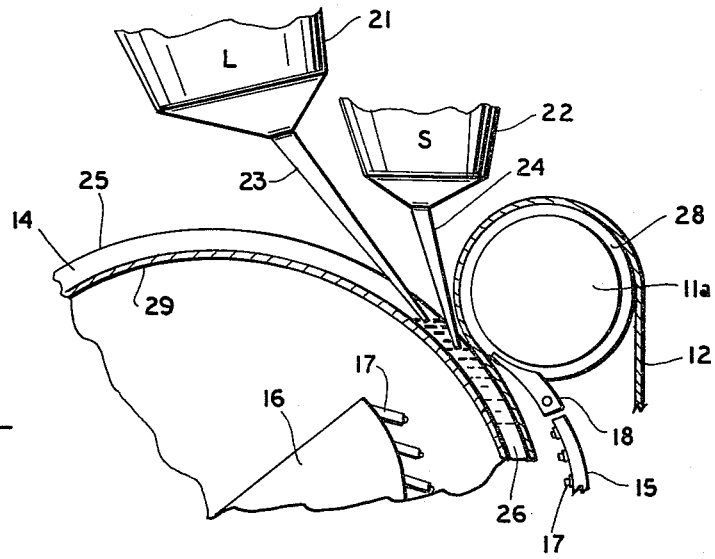
FIG. 3 is a view of a portion of the casting machine embodying the apparatus of the invention and arranged to practice the method of the invention, at the location of introduction of molten metal, showing a second embodiment of the invention wherein the tundishes are simultaneously in position for introducing molten metal.

As best shown in FIG. 3, in a second embodiment of the present invention pouring pots or tundishes 21 and 22 equipped with metering devices are positioned adjacent one another with spouts 23 and 24 so constructed and positioned as to be able to introduce molten metal into the mold simultaneously or in quick succession. Tundish 22 containing the metal of relatively higher melting point is positioned closest to band positioning roller 11*a* and its spout 24 extends a slight distance into the mold. Tundish 21 containing a metal of lower melting point has spout 23 positioned slightly upwards in the casting wheel peripheral groove 14 from spout 24.

OPERATION

When the operator is to begin the continuous casting of a first metal having a relatively high melting point, such as steel, in casting machine 10, the operator goes through the usual start-up procedures, which include preheating the tundishes 21 and 22, drying the flexible band 12 and peripheral groove 14 to assure that no moisture is present on these surfaces, heating the first metal such as steel, and a second metal having a melting point lower than the first metal, such as lead, in furnaces until they are molten, and delivering the molten metals to their respective tundishes by launders. In the tundishes, the temperature of the second molten metal is substantially lower than that of the first molten metal.

Tundish 21 containing lead is positioned for introducing molten lead through spout 23 into the mold. Preliminary cooling as described in U.S. Pat. No. 3,596,702 may be carried out as molten lead is introduced into the mold at a temperature substantially lower than the temperature of the molten first metal. Immediately after the initial introduction of molten lead into the mold, full volume cooling is begun through headers 15 and 16 which provide coolant to nozzles 17 which spray coolant against the exterior surfaces of the mold. The second metal, such as lead, must have a freezing point such that the full volume cooling described above will solidify the second metal before it reaches the point where the flexible band 12 is guided away from the casting wheel 25.

When solidified second metal completely fills the cross-sectional area of the mold formed between the peripherally groove 14 and the flexible band 12 of the introduction of second metal may be terminated. Alternately, second metal may be introduced until the mold fills up to the point of introduction of molten metal, so that the molten second metal will prevent any coolant from splashing down into the mold and will be heating the mold vaporize any coolant that might splash near the point of introduction of molten metal into the mold.

According to the first embodiment of the invention, after the termination of introduction of second metal, such as lead, tundish 21 is moved away from casting machine 10 and tundish 22, containing relatively hotter molten first metal, such as steel, is positioned so that spout 24 can introduce molten steel directly behind the second metal which occupies the mold. Thereafter the operator starts the rotation of the casting wheel and begins to introduce molten steel into the mold. It is a matter of operator choice whether the introduction of molten steel is begun immediately before rotation of the wheel is begun or if the order is reversed. The molten steel introduced into the mold forms a bond with the end of the lead plug previously poured. As the casting wheel rotates, the lead bar will lead the steel bar out of the casting machine 10 and thus will make movement of the steel bar more predictable and more easily accomplished by mechanical bar conveying means.

The pouring of the lead plug using conventional methods known to be safe for both the mold and the operator allows molten steel to be introduced into the mold following the lead plug without danger of explosive contact with liquid coolant. In addition, molten steel is introduced only after full volume cooling of the mold is initiated, and therefore the great heat of the molten steel will be carried away and prevented from melting or otherwise deteriorating the mold materials. The fact that the molten steel will not be introduced until full volume cooling is accomplished allows the mold and flexible band to be constructed of materials which have good heat conductivity but which also have melting points well below the temperature of molten steel.

Furthermore, the presence of the lead plug preheats the mold so that the thermal shock to the mold materials upon coming into contact with the molten steel is reduced, with a concomitant reduction in the deterioration caused by thermal shock because the difference in temperature between the mold and the molten steel is reduced. It should be noted that heat from the lead is conducted transversely through the walls of the mold, including the band, and also longitudinally along the length of the mold. The longitudinal diffusion of heat preheats the mold above the highest level reached by the lead plug. The transverse diffusion of heat, which is accelerated by the cooling, prevents the existence of any sharp drop in temperature at any point across the thickness of the mold where deterioration might be sustained because of thermal shock caused by the initial wave of heat from the molten steel.

In order to take advantage of the preheating of the mold by the lead plug, the pouring of the steel must begin as soon as possible after the plug is poured before any significant cooling of the plug has occurred.

In the second embodiment, as shown in FIG. 3, the tundishes 21 and 22 are both positioned for pouring into the mold during the entire starting procedure. When the molten first metal has solidified across the cross-section of the mold three steps may take place in rapid succession: the introduction of molten first metal, the beginning of rotation of the casting wheel, and the termination of introduction of molten second metal. Alternatively, the casting wheel may be turning continuously during the entire procedure, that is, while both the second and first metals are being poured. Thus, the waiting period which is necessary using the first embodiment while tundish 21 is removed from pouring position and tundish 22 is moved into pouring position may be eliminated, and full advantage of the preheating of the mold by the lead plug may be taken before the solidified plug has an opportunity to cool. A further advantage of the second embodiment is that no time period will exist wherein liquid coolant might splash into the mold and come in contact with molten metal.

In the process of the present invention, it is possible that alloys of first and second metal may form at the point where the two metals meet, but such alloy formation should not lessen the effectiveness of the present invention. The portion of lead bar which is cast in order to start the steel casting may be cut from the steel bar and remelted to be used again as a starting plug.

While this invention has been described in detail with particular reference to preferred embodiments thereof, it will be understood that variations and modifications can be effected within the spirit and scope of the invention as described hereinbefore and as defined by the appended claims.

I claim:

1. A method of casting a molten first metal at a particular temperature in a mold formed of a material having a melting point temperature below said particular temperature, comprising the steps of:

A. pouring a molten second metal into said mold at a temperature substantially below said particular temperature;

B. applying coolant to said mold until said second metal has solidified in said mold and the temperature of said mold has been increased by the continuing transfer of heat from said second metal through said mold to said coolant;

C. terminating the pouring of said second metal and initiating the casting of said first metal while continuing to apply coolant to said mold in a quantity sufficient to continue the transfer of heat through said mold to said coolant.

2. Method of starting the continuous casting of a first metal having a particular melting point in a continuous casting machine having a mold therein, comprising the steps of:

A. introducing a molten second metal having a melting point lower than the melting point of said first metal into said mold at a temperature substantially lower than the molten temperature of said first metal;

B. cooling said mold containing said second metal;

C. terminating introduction of said second metal when a cross-section of said mold is filled by solidified second metal;

D. introducing molten first metal into said mold while continuing to cool said mold.

3. The method of claim 2 wherein said continuous casting machine is a casting wheel having a mold formed by engaging the peripheral groove of said wheel with a continuous flexible band, and wherein rotation of said casting wheel is begun after the termination of introduction of said second metal and prior to the introduction of said first metal.

4. The method of claim 2 wherein said first metal has a melting point higher than the melting point of said mold; and wherein said second metal has a melting point lower than the melting point of said mold.

5. The method of claim 2 wherein said first metal has a melting point sufficiently higher than room temperature that the thermal shock of initial contact between said molten first metal and said mold would seriously deteriorate said mold.

6. Method of claim 2 wherein said first metal is steel.

7. Method of claim 2 wherein said second metal is lead.

8. Method of claim 2 wherein said second metal termination step comprises: terminating introduction of said second metal after a predetermined amount of said second metal has been introduced into said mold.

9. A method of starting the continuous casting of a first metal in a mold formed by engaging the peripheral groove of a rotatable casting wheel with a continuous flexible band, said first metal having a melting point higher than the melting point of said mold, comprising the steps of:

A. introducing into said mold a molten second metal having a melting point lower than the melting point of said mold at a temperature substantially lower than the molten temperature of said first metal;

B. immediately cooling said mold at a rate sufficient to prevent said mold from melting on contact with said first metal;

C. terminating the introduction of second metal when said mold has filled to the point of introduction of said molten metal;

D. immediately introducing molten first metal into said mold while continuing to cool said mold.

10. The method of claim 9 wherein rotation of said casting wheel is begun after terminating the introduction of said second metal and prior to introducing said first metal.

11. Method of claim 9 wherein said first metal is steel.

12. Method of claim 9 wherein said second metal is lead.

13. Method of claim 9 wherein said second metal termination step comprises: terminating introduction of said second metal after a predetermined amount of said second metal has been introduced into said mold.

14. The method of claim 9 wherein the step of introducing molten first metal occurs immediately prior to the step of rotating said casting wheel.

15. The method of claim 9 wherein the step of introducing molten first metal occurs before any significant cooling of said second metal occurs following solidification of said second metal across a cross-section of said mold.

16. Method for starting the continuous casting of a first metal having a particular melting point in a mold formed by engaging the peripheral groove of a rotatable casting wheel with a continuous flexible band, comprising the steps of:

A. introducing into said mold a molten second metal having a melting point below the melting point of said first metal;

B. immediately cooling said mold;

C. filling said mold with molten second metal to the point of introduction of said second metal; and D. immediately and approximately simultaneously 1. rotating said casting wheel;
2. terminating introduction of second metal; and
3. introducing molten first metal while continuing to cool said mold.

17. The method of claim 16 wherein said first metal has a melting point higher than the melting point of said mold; and wherein said second metal has a melting point lower than the melting point of said mold.

18. The method of claim 16 wherein said first metal has a melting point sufficiently higher than room temperature that the thermal shock of initial contact between said molten first metal and said mold would seriously deteriorate said mold.

19. Method of claim 16 wherein said first metal is steel.

20. Method of claim 16 wherein said second metal is lead.

21. Method of claim 16 wherein said second metal termination step comprises: terminating introduction of said second metal after a predetermined amount of said second metal has been introduced into said mold.

22. A method of starting the continuous casting of steel in a mold formed by engaging the peripheral groove of a rotatable casting wheel with a continuous flexible band, comprising the steps of:

A. introducing molten lead into said mold;

B. immediately cooling said mold;

C. terminating the introduction of said lead when solidified lead fills the cross-section of said mold;

D. rotating said casting wheel; and

E. immediately introducing molten steel into said mold while continuing to cool said mold.

23. Apparatus for starting the continuous casting of a first metal having a particular melting point comprising:

a mold formed by engaging the peripheral groove of a rotatable casting wheel with a continuous flexible band;

means for introducing a molten second metal having a melting point lower than the melting point of said first metal into said mold at a temperature substantially lower than the molten temperature of said first metal so as to fill the cross-section of the mold;

means for cooling said mold at a particular rate;

means for terminating introduction of said second metal when a cross-section of said mold is filled by solidified second metal; and means for introducing molten first metal into said mold while said rate of cooling of said mold is maintained.

24. The apparatus of claim 23 wherein said rate of heat transfer from said mold is sufficient to prevent thermal damage to said mold upon contact of said first metal with said mold.

25. The apparatus of claim 23 wherein said introduction means for said first and second metal includes a pair of tundishes positioned to be capable of simultaneously introducing molten metal into said mold.

26. The apparatus of claim 23 wherein said introduction means for said first and second metals includes two tundishes, only one of which is positioned to introduce molten metal into said mold, and means for interchanging said tundishes within a span of time shorter than the time required for any significant cooling of said second metal to occur within said mold following solidification of said second metal across a cross-section of said mold.

27. The apparatus of claim 23, wherein the melting point of said first metal is higher than the melting point of said mold; and wherein said rate of heat transfer from said mold is sufficient to prevent said mold from melting on contact with said molten first metal.

* * * * *